US008079415B2

(12) United States Patent
Cook

(10) Patent No.: US 8,079,415 B2
(45) Date of Patent: Dec. 20, 2011

(54) WELLBORE INTERVENTION TOOL

(75) Inventor: John Cook, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 133 days.

(21) Appl. No.: 12/159,741

(22) PCT Filed: Nov. 28, 2006

(86) PCT No.: PCT/GB2006/004429

§ 371 (c)(1),
(2), (4) Date: Oct. 15, 2008

(87) PCT Pub. No.: WO2007/077411

PCT Pub. Date: Jul. 12, 2007

(65) Prior Publication Data

US 2009/0218097 A1 Sep. 3, 2009

(30) Foreign Application Priority Data

Dec. 30, 2005 (GB) ..... 0526636.6

(51) Int. Cl.
*E21B 47/00* (2006.01)
*E21B 37/00* (2006.01)

(52) U.S. Cl. ..... 166/277; 166/66; 166/222; 166/255.1; 166/312

(58) Field of Classification Search ..... 166/312, 166/250.01, 250.17, 66, 277, 222, 223, 255.1
See application file for complete search history.

(56) References Cited

U.S. PATENT DOCUMENTS

| | | | | |
|---|---|---|---|---|
| 3,527,302 | A | 9/1970 | Broussard | |
| 3,765,484 | A | 10/1973 | Hamby, Jr. et al. | |
| 4,525,815 | A | 6/1985 | Watson | |
| 4,793,417 | A | 12/1988 | Rumbaugh | |
| 5,195,588 | A | 3/1993 | Dave | |
| 5,692,565 | A | 12/1997 | MacDougall et al. | |
| 5,816,343 | A | 10/1998 | Markel et al. | |
| 6,041,860 | A * | 3/2000 | Nazzal et al. | 166/250.01 |
| 6,173,768 | B1 * | 1/2001 | Watson | 166/68 |
| 6,173,773 | B1 | 1/2001 | Almaguer et al. | |
| 2003/0183385 | A1 | 10/2003 | Hook et al. | |
| 2008/0307877 | A1 | 12/2008 | Cook et al. | |

FOREIGN PATENT DOCUMENTS

| | | | |
|---|---|---|---|
| FR | 2646463 | A1 | 11/1990 |
| GB | 2179981 | A | 3/1987 |
| GB | 2420357 | A | 5/2006 |
| GB | 2433754 | A | 7/2007 |
| WO | 2006054074 | A1 | 5/2006 |
| WO | 2007077411 | A1 | 7/2007 |

* cited by examiner

*Primary Examiner* — Hoang Dang

(57) ABSTRACT

The present invention provides a conveyance tool and a tool string having one or more sensors or cameras for detecting the performance of pre-existing perforations in a cased wellbore, and one or more perforation intervention tools mounted on the tool string and capable of performing remedial actions directed at most one perforation and its nearest neighbors or at a single perforation.

7 Claims, 3 Drawing Sheets

WELLBORE INTERVENTION TOOL

The subject matter of the present invention relates to perforating operations. More specifically, the present invention relates to a conveyed wellbore intervention tool for perforations.

BACKGROUND OF THE INVENTION

After drilling a wellbore into a hydrocarbon-bearing formation, the well is completed in preparation for production. To complete a well, a casing (liner), generally steel, is inserted into the wellbore. Once the casing is inserted into the wellbore, it is then cemented in place, by pumping cement into the gap between the casing and the borehole (annulus). The reasons for doing this are many, but essentially, the casing helps ensure the integrity of the wellbore, i.e., so that it does not collapse. Another reason for the wellbore casing is to isolate different geologic zones, e.g., an oil-bearing zone from an undesirable water-bearing zone. By placing casing in the wellbore and cementing the casing to the wellbore, then selectively placing holes in the casing, one can effectively isolate certain portions of the subsurface, for instance to avoid the co-production of water along with oil.

The process of selectively placing holes in the casing and cement so that oil and gas can flow from the formation into the wellbore and eventually to the surface is generally known as "perforating." One common way to do this is to lower a perforating gun into the wellbore using a wireline or slickline cable to the desired depth, then detonate a shaped charge mounted on the main body of the gun. The shaped charge creates a hole in the adjacent wellbore casing and the formation behind the casing. This hole is known as a "perforation". U.S. Pat. No. 5,816,343, assigned to Schlumberger Technology Corporation, incorporated by reference in its entirety, discusses prior art perforating systems.

In order to optimize the performance of perforated completions, it is necessary to know the details of the completion behaviour. For example, it is beneficial to know which perforations are flowing and which are not due to conditions such as formation debris blockage or tunnel collapse. Additionally, it is beneficial to know what fluids are flowing from the individual perforations and which tunnels are producing sand as well as hydrocarbons. If the behavioural details of the individual perforations are known, then treatments for detrimental conditions can be appropriately applied.

Related oilfield technology exists in a number of areas. For example, for open hole sections of the well, images are frequently acquired using tools such as the Ultrasonic Borehole Imager (i.e., acoustic pulses), the Formation Microscanner (i.e., electrical resistivity) or the GeoVision resistivity tool. However, these devices are not applicable to cased hole environments.

In cased holes, Kinley calipers or similar tools are used to form maps of damage or holes in casing by using mechanical feelers as the sensing elements. Downhole video cameras can also be used to view perforations in cased holes, but the well must be shut-in (or very nearly shut-in) and filled with filtered fluid for the cameras to be effective. Temperature logs and production logging tools can be used in cased holes but have no azimuthal sensitivity and insufficient depth resolution to detect problems with individual perforations.

A technology has been proposed the international Patent application PCT/GB2005/004416 filed on 16 Nov. 2005 to use a wireline tool with pads containing arrays of flow, sand and fluid type sensors, to map the inflow in a perforated completion. In principle the apparatus and methods described in the application enable the detection of individual non-flowing, sand-producing or watered-out perforation holes.

The location of these non-performing perforations can thus be established with some precision, at least relative to the tool body.

In case perforated completions suffer from limited productivity or other faults, various methods have been proposed and are used in remedial operations. These remedial methods include bullheading acid, re-perforation, pressure jetting and ultrasound excitation. All these remedial methods, for sand, water and poor productivity, are not selective and address an entire completed interval at least.

There exists, therefore, a need to optimize remedial operations on existing but non-performing perforations in perforated sections of a wellbore.

SUMMARY OF THE INVENTION

According to an aspect of the invention, there is provide a apparatus which is adapted to be conveyed into a wellbore by a wireline, drill string, coiled tubing or other suitable conveyance methods, which apparatus being capable of

- detecting a perforation;
- establishing whether or not the perforation is performing according to a preset condition or parameter;
- and launching an intervention tool adapted to perform a local remedial operation on a non-performing perforation only or at the most on the non-performing perforation and its closest neighbors.

The detection and performance check on perforation are preferably performed using a visual or optical inspection or a perforation specific flow detection tool such as described for example in the aforementioned international Patent application PCT/GB2005/004416 fully incorporated herein by reference.

The intervention tool is preferably based on apparatus and methods described for the purpose of drilling perforations into cased wellbores in the U.S. Pat. No. 5,692,565 fully incorporated herein by reference. It was found that the apparatus described therein can be adapted to provide a tool for individually engaging a non-performing perforation.

Among the preferred remedial operations are ultrasonic or jet cleaning, injection of chemicals such as swelling polymers, gels, or acids, filter placements using for example wire, polymer or carbon filters, sealing operations based either on chemical injection as above or the installation of mechanical seals or valves or packers.

A preferred tool in accordance with the invention includes a depth control to position the intervention tool at the depth of a previously identified non-performing perforation.

A preferred tool in accordance with the invention includes an azimuthal control to position the intervention tool at the approximate or exact azimuthal angle of a previously identified non-performing perforation.

An even more preferred tool in accordance with the present invention includes a depth and azimuthal control to position the intervention tool in juxtaposition to the opening of a previously identified non-performing perforation These and other aspects of the invention will be apparent from the following detailed description of non-limitative examples and drawings.

DETAILED DESCRIPTION

Figure 1A:
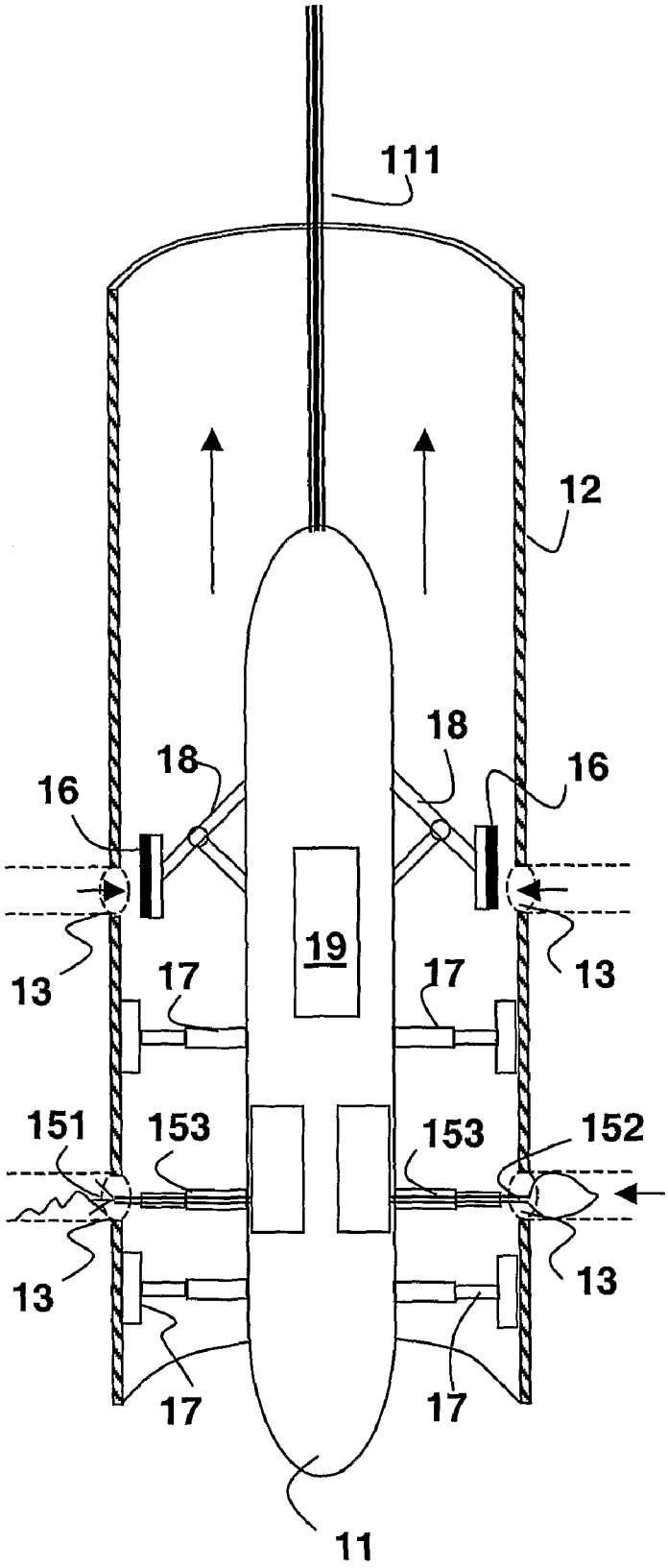
FIG. 1A illustrates an embodiment of the present invention.

A first embodiment of the present invention is illustrated in FIG. 1A. In this embodiment, one or more sensors 16 are placed on an equivalent number (only two shown) of arms 18 that extend in operation from the main body 11 of the tool. The main body 11 is moved in the wellbore on a conveyance tool 111, which can be a wireline, coiled tubing, a drillstring or any other suitable conveyance apparatus. In this configuration, the extending arms 18 enable the sensors 16 to fold up easily to facilitate passage through the casing 12 and to be brought into close proximity to the opening 13 of perforations. The sensors 16 are shown oriented such that their sensitive face is oriented towards the flow from the perforations and less exposed to the main flow. Arrows indicate the respective flow directions.

In a variant not shown for the sake of clarity, the sensors 16 are placed in a protective cage such that the arms 18 can be extended in operation against the inner wall of the casing 12 without causing damage to the sensors.

In a lower part of the tool body there are shown two perforation intervention tools 151, 152 representative of a group of intervention tools which may include ultrasonic or jet cleaning tools, chemical injection tools, or carriers or placements tool for filters, mechanical seals, valves or small packers to close or constrict the perforations.

The tools 151, 152 are mounted on telescopic arms 153 which extend from the tool body 11 to the opening 13 of a perforation and, if required, into the perforation.

There are also shown pads 17 which can in operation been extended against the casing to provide a counterforce and/or anchor the tool body in the wellbore.

The extendable devices arms 153, 17, 18 are hydraulically operated or use electric actuators for extending, positioning and retraction into the tool body.

The tool includes electronic devices 19 to control the downhole operation of the tool and to communicate measurements to the surface and to receive instructions from a surface operator.

Figure 1B:
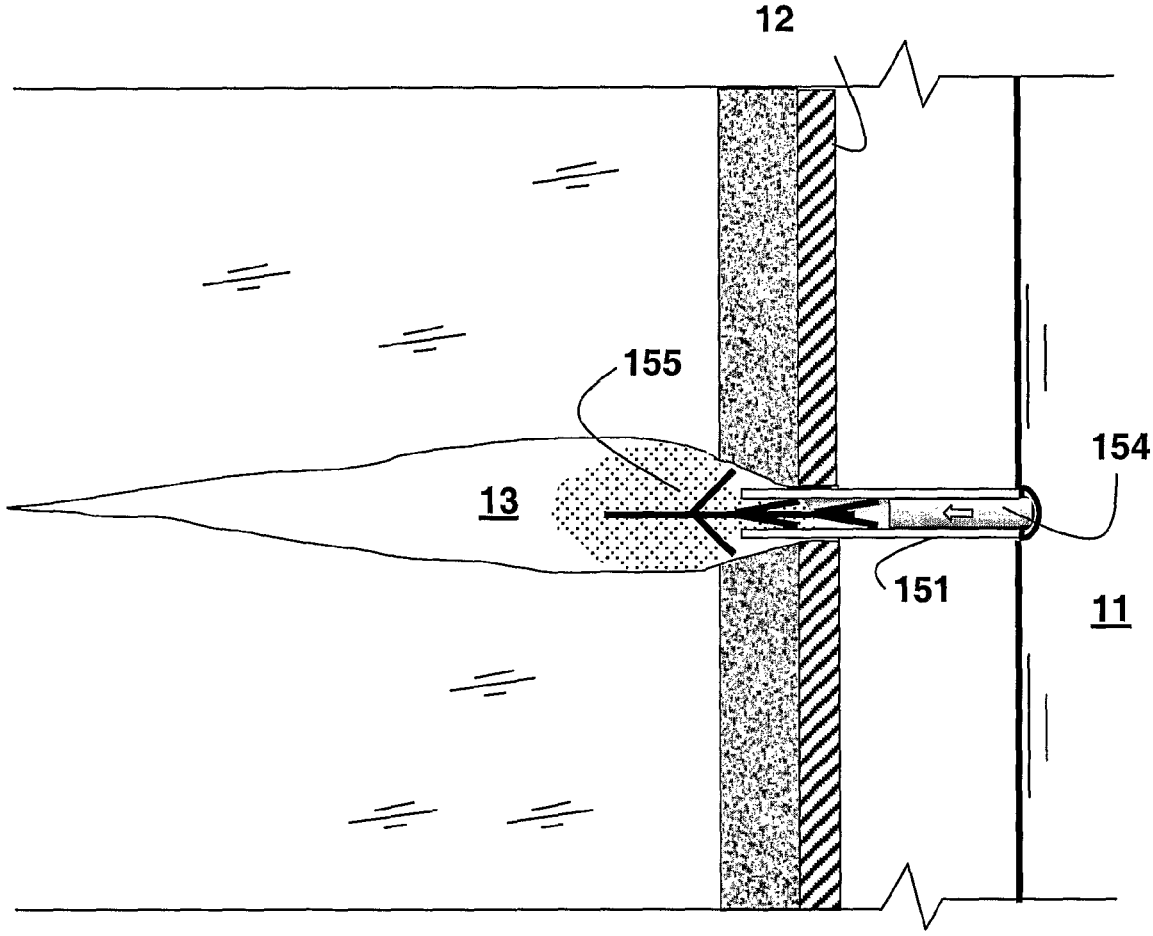
FIG. 1B illustrates a detail of FIG. 1A.

A more detailed view of a perforation intervention tool for sand control purposes is shown in FIG. 1B retaining the numerals used in FIG. 1A for identical or similar elements. The intervention tool inserts a tube 151 (shown cutaway) into the perforation tunnel 13, and a coaxial piston 154 then pushes a sand control plug 155 into the tunnel as the tube withdraws. The plug is made of an elastic mesh that springs open as it is released from the tube, together with an elastic fishbone structure that provides some support to the mesh and also locks it within the tunnel.

Figure 2:
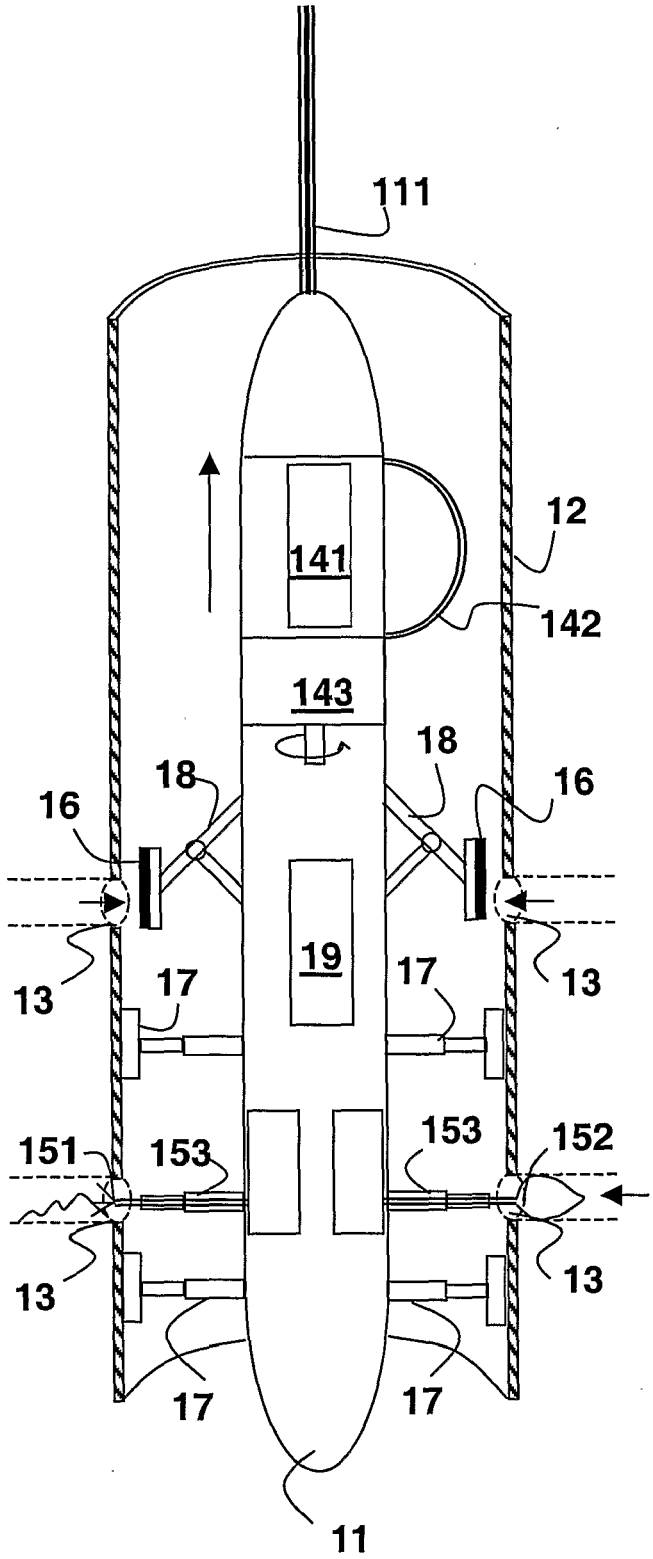
FIG. 2 illustrates a further variant of the present invention.

In FIG. 2, the tool of FIG. 1 is shown, again retaining the numerals used in FIG. 1A for identical or similar elements, enhanced by an azimuthal orientation tool 14 comprising an gyroscopic instrumentation and control section 141, an anchor 142 shown as a bow spring to anchor the top of the tool to the casing and a motor 143 to rotate the intervention tool into a desired azimuthal orientation. Such an orientation section is described for general downhole applications for example in the U.S. Pat. No. 6,173,773, fully incorporated herein by reference.

In operation, the tool is first lowered into a wellbore and then pulled slowly back to the surface with its arms 18 extended and sensors 16 placed close to or touching casing wall.

Once a problem perforation has been located, mechanical tools below the detection pads can be deployed to fix it. Using the known depth difference between detector pads 16 and the intervention tool 151, 152, the tool is stopped in the appropriate position, and be anchored there; the anchoring does not need to be powerful, and the anticipated treatments would not take much time per hole. Possible mechanical fixes then applied include:

For a perforation hole that is not flowing, or flowing much less than its neighbors—anchor the tool and insert a stimulation device through the perforation hole into the tunnel or whatever is obstructing it. This device could be an ultrasonic source, a mechanical drill or agitator, a pellet of propellant with an ignitor, a high-pressure jet of wellbore fluid, or some other source of mechanical energy. The aim is to disrupt fines accumulations around the perforation tunnel, or shake free whatever is blocking the hole.

For a tunnel that is flowing too much water—anchor the tool and either a) insert a tube into the hole and tunnel which deposits a swelling gel pellet to fill the tunnel and prevent flow, or b) block the casing hole itself with a metal-to-metal sealing plug of the type used in the CHDT. A perfect seal is not needed.

For a tunnel that is flowing sand—anchor the tool and either a) block the hole as for water shutoff, or b) insert a tube into the tunnel and deposit a mesh filter plug in the tunnel, which allows fluid to flow but blocks sand particle movement, or c) insert a tube and deposit a miniature gravel pack within the perforation, using resin-coated gravel which is then cured by an UV source or the subsequent injection of a chemical activator.

There are other intervention possibilities.

In the case of sand control the insertion of a filter plug would be a permanent solution, until reservoir or drawdown conditions change so that other perforations start to fail, or until the filter plug is damaged or dissolved by the production flow. As such it could potentially be a method for primary sand control, during the initial completion of the well. It leaves the wellbore entirely free of obstruction, and is repairable as required using a similar tool.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An apparatus for remedial operations in a wellbore comprising a conveyance tool and a tool string, the tool string comprising a plurality of extendable arms each of the extendable arms including a sensor pad comprising a plurality of sensors, wherein each of the plurality of extendable arms is configured in use to extend from the tool string with the sensor pad positioned such that a sensitive face of the sensor is oriented towards a flow from a one or more pre-existing perforations in the casing, and wherein the plurality of sensors are configured to map flow characteristics of the pre-existing perforations, and one or more perforation intervention tools mounted on the tool string and capable of performing remedial actions directed at most one perforation and its nearest neighbors.

2. The apparatus of claim 1, wherein the perforation intervention tool is adapted to perform remedial actions directed at a single perforation detected as non-performing.

3. The apparatus of claim 1, wherein the intervention tool is selected from a group consisting of ultrasonic or jet cleaning tools, chemical injection tools, or carriers or placements tool for filters, mechanical seals, valves or small packers to close or constrict the perforations.

4. The apparatus of claim 1, wherein the plurality of sensors comprise flow sensitive sensors for monitoring the flow from a one of the pre-existing perforations.

5. The apparatus of claim 1, wherein the perforation intervention tool has a controllable azimuthal orientation in the wellbore.

6. A method of improving the performance of existing perforations in a cased wellbore, said method comprising the steps of:

lowering a tool body into the wellbore;

using an arm extending from the tool body to position a plurality of sensors proximal to the casing with a sensing face of each of the plurality of sensors directed towards the casing;

using the plurality of sensors to map fluid flow through one or more pre-existing perforations in the casing;

using the fluid flow map to determine a location of a non-performing perforation;

using the determined location to position the tool body such that a perforation intervention tool mounted on the tool body can engage the non-performing perforation; and performing a remedial operation on the non-performing perforation.

7. The method of claim 6, wherein the remedial operation is an operation selected from a group consisting of ultrasonic or jet cleaning, injection of chemicals such as swelling polymers, gels, or acids, filter placements using wire, polymer or carbon filters, sealing operations based either on chemical injection as above or the installation of mechanical seals or valves or packers.

* * * * *